United States Patent [19]

Berry et al.

[11] 4,083,541

[45] Apr. 11, 1978

[54] OXYGEN LANCE ASSEMBLY

[75] Inventors: William W. Berry, Pittsburgh; Leo L. Meinert, Beaver; Nicholas M. Rymarchyk, Pittsburgh, all of Pa.

[73] Assignee: Pullman Berry Company, Harmony, Pa.

[21] Appl. No.: 795,245

[22] Filed: May 9, 1977

[51] Int. Cl.[2] ..... C21C 5/32

[52] U.S. Cl. ..... 266/225

[58] Field of Search ..... 266/225, 226; 239/132.3

[56] References Cited

U.S. PATENT DOCUMENTS 3,972,515 8/1976 Mercatoris ..... 266/225

*Primary Examiner*—Gerald A. Dost

*Attorney, Agent, or Firm*—Thomas G. Anderson

[57] ABSTRACT

A steel making oxygen lance assembly includes a top support member having oxygen, water inlet and outlet pipes connected to a supply source and discharge source. A connecter assembly includes first upper and second lower annular members with aligned slots which are secured together by a quick disconnect arrangement. The lower connecter includes a ring which has pipes connected thereto providing communication with the pipes on the top support member. One of the connecter members also has a replaceable sleeve connected thereto which also includes openings in registry with the slots. A vent arrangement provides for positive venting of any leakage. O-rings are provided to prevent leakage between the pipes and contacting surfaces.

12 Claims, 7 Drawing Figures

OXYGEN LANCE ASSEMBLY

CROSS-REFERENCE TO RELATED PATENT APPLICATIONS

The instant patent application is related to the following five co-pending patent applications which were filed in the patent office on the same date as the instant application:

Ser. No. 795,243 Filed May 9, 1977
Ser. No. 795,244 Filed May 9, 1977
Ser. No. 795,247 Filed May 9, 1977
Ser. No. 795,248 Filed May 9, 1977
Ser. No. 795,246 Filed May 9, 1977

BACKGROUND OF THE INVENTION

1. Field of the Invention

The invention relates to lances used in the basic oxygen furnace steel making process.

2. Description of the Prior Art

Patents in the prior art include U.S. Pat. No. 3,620,455 Nov. 16, 1971; 3,827,632 Aug. 6, 1974; 3,912,244 Oct. 14, 1975; RE: 28,769 Apr. 13, 1976 and 3,972,515 August 3, 1976. The present invention is an improvement over these patents.

SUMMARY OF THE INVENTION

The oxygen lance of the present invention is one that is readily disconnected from a carriage adjacent to the basic oxygen furnace vessel. A top support assembly includes oxygen water inlet and outlet pipes connected to a supply and discharge source and the support assembly remains fixed on the support carriage and the remainder of the lance can be removed and replaced quickly by virtue of the improved arrangement.

The top supply member includes a first connector plate assembly which includes openings communicating with the oxygen and water inlet and outlet pipes. A plate on the first assembly includes a lower flat surface to which the flange or flat surface of a sleeve is removeably connected, the latter also including openings in registry with the aforementioned openings.

A second lower connecter assembly in the form of a ring has oxygen, water inlet and outlet pipes connected to the rings which also has openings registering with the sleeve flange openings to provide for communication. A nozzle at the latter pipes including a water chamber and discharge orifice are included in the assembly. The assembly can quickly be disassembled for purpose of repair and replacement. Because of the ease of disassembly and simplicity, the repair and replacement of various parts can be done at the site of the furnace.

The various pipes and contacting surfaces are effectively sealed by O-rings which can easily be replaced. Any possible leakage of water or oxygen is quickly vented to the atmosphere by the novel venting arrangement of the invention.

DESCRIPTION OF THE PREFERRED EMBODIMENT

Figure 1:
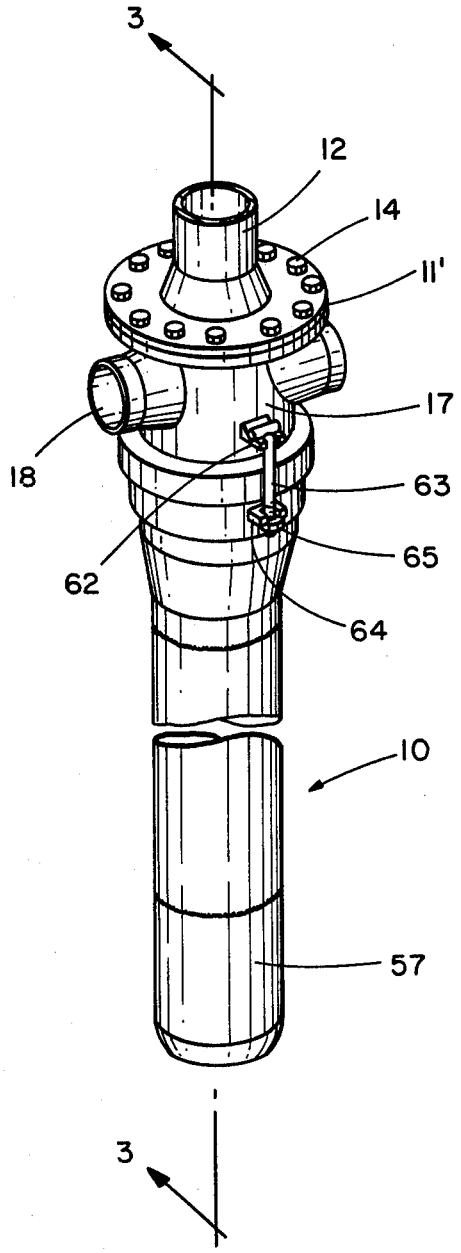
FIG. 1 is a perspective view of an improved oxygen lance.

An oxygen lance assembly 10 includes a top support member 11 having an upper plate 11' connected to an oxygen supply pipe 12. An annular plate 13 is connected to the plate 11' by means of bolts and nuts 14. The top support member may be rigidly mounted on a lance carriage (not shown) adapted to be moved for operation adjacent to a basic oxygen vessel. The support member 11 includes a first oxygen pipe 15 and second and third water inlet and outlet pipes respectively 16 and 17. The outlet pipe 17 is connected to an outlet connector 19, and the inlet 16 is connected to an inlet connector 18.

An upper connector plate assembly is designated at 20 and includes a flat plate 21 having a lower flat surface 22 provided with a central opening 23 communicating with the oxygen pipe 15. The flat plate 21 includes a plurality of circumferentially disposed arcuate slots 24 and 25 positioned in radially spaced rows. The term "circumferentially disposed" for the present disclosure is to indicate that the slots above and hereafter further described are spaced in an annular ring like or cylindrical manner in the flat plates. The slots 24 and 25 communicate respectively with the water inlet and outlet pipes 16 and 17.

A second connector plate assembly 26 includes a sleeve 27 which projects downwardly and is provided with an upper bore 28 communicating with the opening 23 and the first oxygen pipe 15. The sleeve 27 includes an upper flange or annular plate 29 having two rows of radially spaced circumferentially disposed arcuate slots 30 and 31 respectively communicating with the arcuate slots 24 and 25. The upper flat surface 32 of the plate 29 is in sealing relation relative to the lower flat surface 22 by means of a pair of radially spaced annular O-rings 33.

Figure 4:
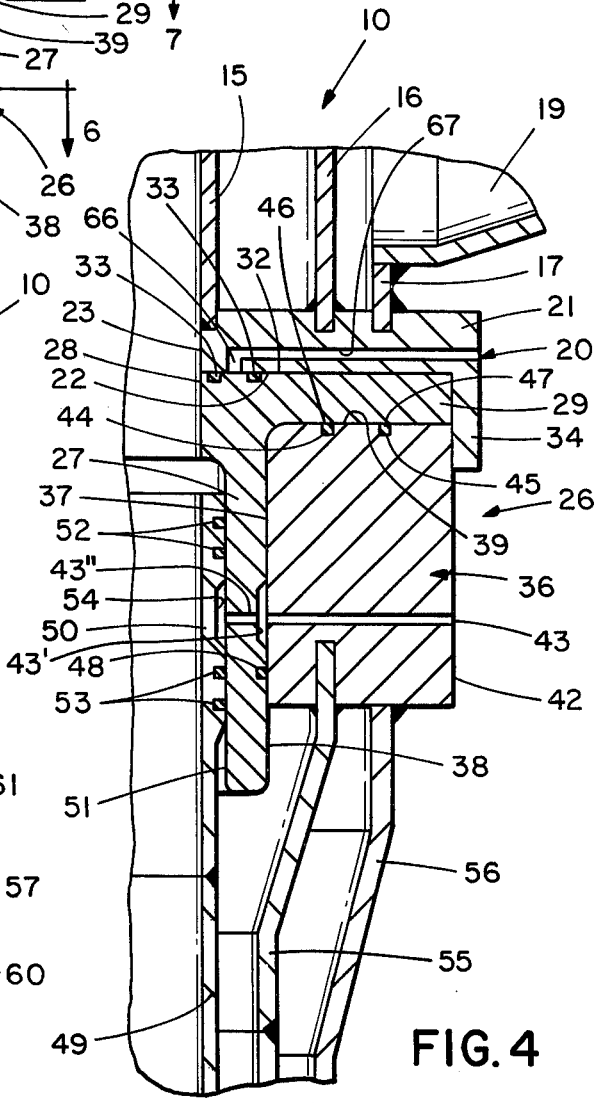
FIG. 4 is an enlarged cross-sectional view of a connecting and sealing arrangement for a connector plate assembly.
Figure 7:
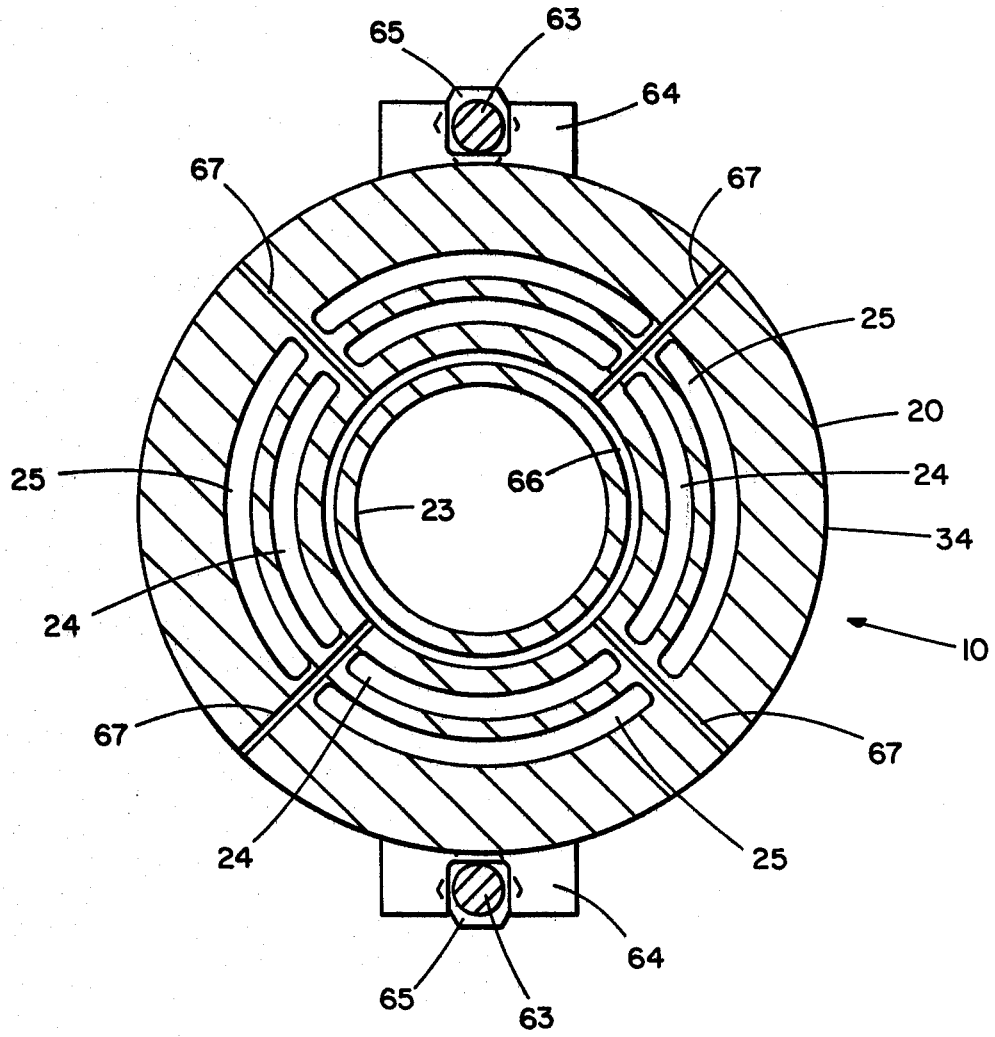
FIG. 7 is a cross-sectional view taken along line 7—7 of FIG. 3.

As best shown in FIGS. 4 and 7, an annular chamber 66 communicating with the atmosphere through radial passages 67 is provided in the plate 21 between the O-rings 33.

Figure 3:
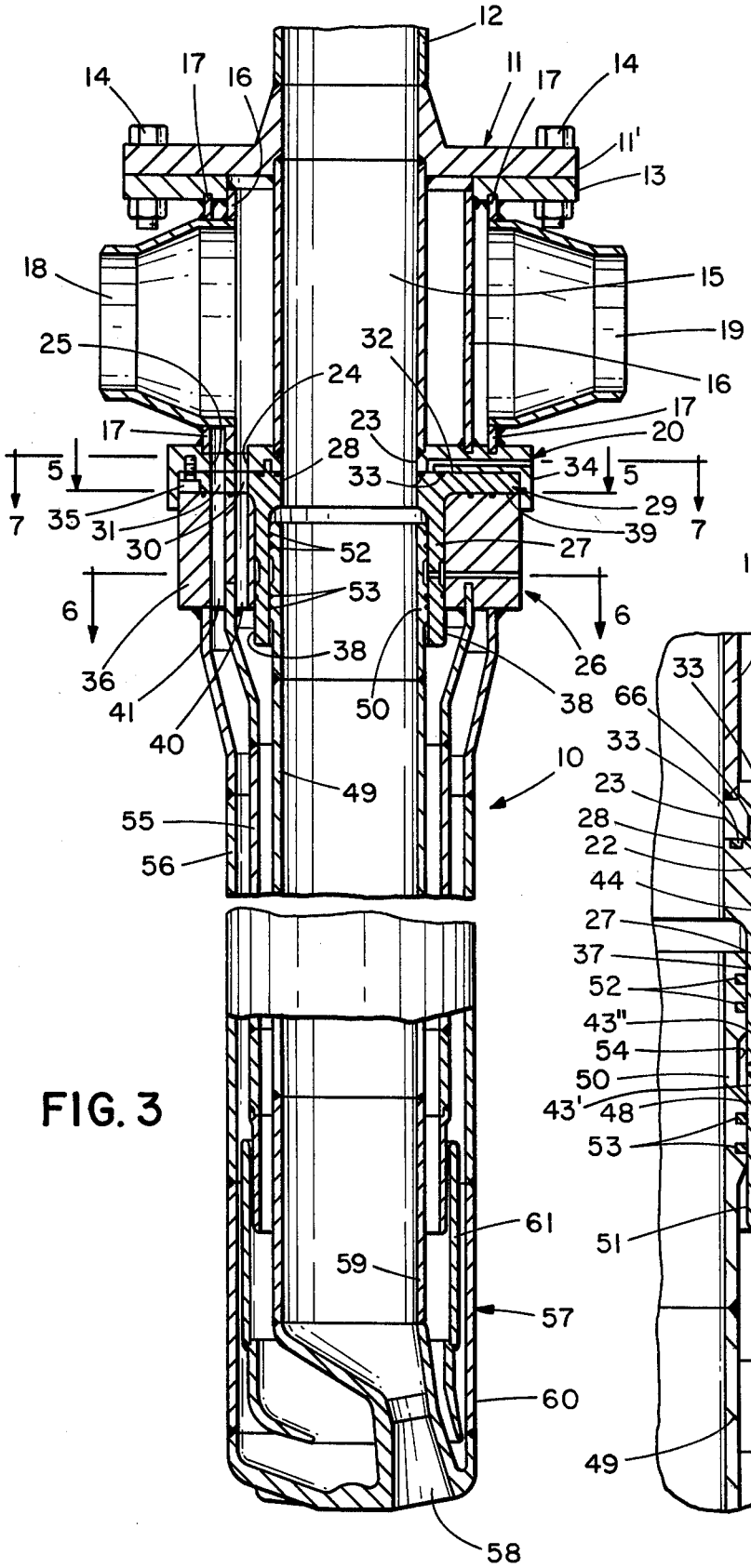
FIG. 3 is a cross-sectioned view taken along the line 3—3 of FIG. 1.

The upper connector plate assembly 20 includes a peripheral downwardly extending flange 34 overlapping the outer peripheral surface of the plate 29. The plate 29 is releasably connected for replacement purposes to the lower surface 22 of the first connector plate assembly by means of cap screws 35, one of which is shown in FIG. 3.

The second connector plate assembly 26 includes a ring 36 having an annular inner surface 37 in telescoping engagement with the outer cylindrical surface 38 of the sleeve 27. The ring 36 includes an upper annular flat surface 39 in sealing engagement with the bottom surface of the plate 29. The ring includes a plurality of arcuate slots 40 and 41, communicating respectively with the slots 30 and 24 and slots 31 and 25.

Figure 5:
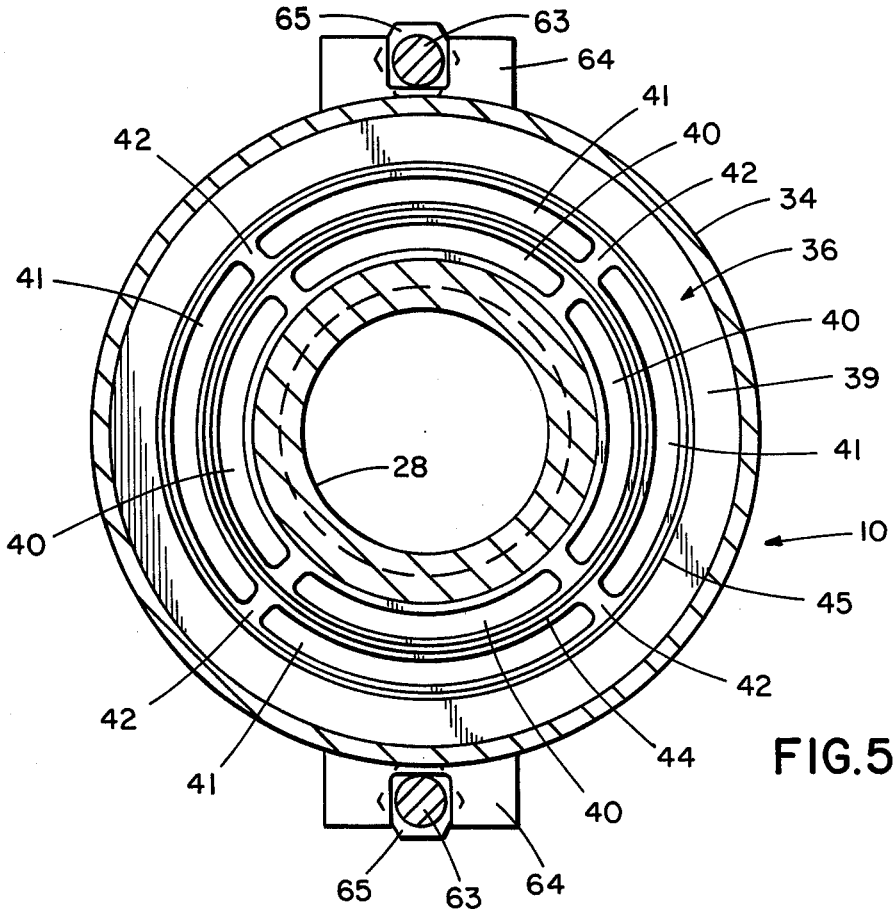
FIG. 5 is a cross-sectional view taken along the line 5—5 of FIG. 3.
Figure 6:
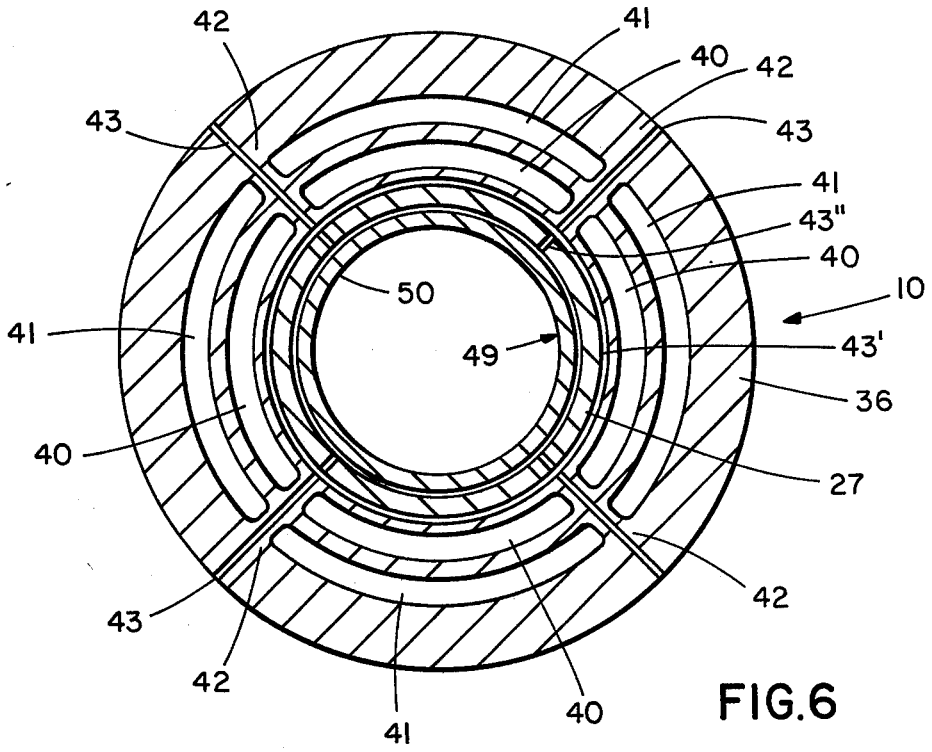
FIG. 6 is a cross-sectional view taken along the line 6—6 of FIG. 3.

The disposition of the circumferentially disposed slots 40 and 41 is disclosed in FIGS. 5 and 6.

Each of the slots are circumferentially spaced to provide in the ring member 36 a plurality of radially extending webs 42 which separate, or provide solid intervening walls in said number 36.

Vent passages 43 are positioned within the webs 42 and extend outwardly for communication with the atmosphere. The vent passages 43 communicate with a peripheral passage 43' and vent passages 43'' in sleeve 27.

All of the slots in the ring 36, the plate 29 and the plate 21 are the same shape and spacing and register with one another in the clamped or connected position of the lance assembly.

As best shown in FIGS. 4 and 5, the upper flat surface of the ring 36 is provided with two annular rows of recesses 44 and 45 containing O-rings 46 and 47 which are positioned adjacent the annular openings 40 and 41 to effectively seal against the leakage of water. The surface 37 and outer surface 38 of the sleeve are also effectively sealed by an O-ring 48.

A lower fourth oxygen pipe 49 includes an upper enlarged piston-like member 50 in relative telescoping or slip joint connection with the inner annular surface 51 of the sleeve 27. Pairs of upper and lower O-rings respectively 52 and 53 are supported on the member 50 and a vent chamber or annulous 54 is provided in the member 50 which communicates with the bores or passages 43 and 43'.

A fifth water inlet pipe 55 and sixth water inlet pipe 56 are connected to the ring 36, project downwardly with respect thereto and communicate with the slots 41 and 40 respectively.

A lance nozzle 57 is welded to the lower pipes and includes an outlet orifice 58 communicating with an oxygen stub pipe 59 which communicates with the oxygen pipe 49. An outer stub pipe 60 is connected to the pipe 56. The pipe 55 is in telescoping relation at its lower end with a stub pipe position 61 to provide a mechanical slip joint connector therebetween. The telescoping relation of the fourth oxygen pipe with the sleeve 27 accommodates a relative sliding movement occurring when the pipe contracts and expands lengthwise due to heat variations. The slip joint between pipe 55 and stub pipe 61 also provides for this occurrence.

Figure 2:
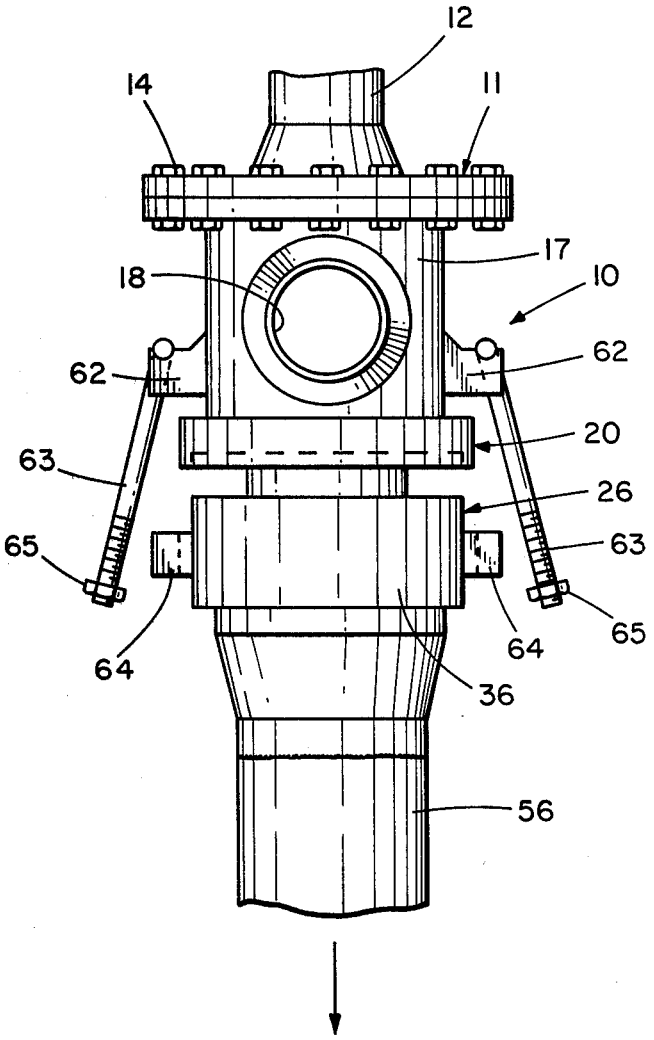
FIG. 2 is an enlarged elevational view of an upper lance portion.

FIG. 2 discloses the quick disconnect and connect arrangement which includes a pair of bosses 62 which are mounted on the pipe 17. Bolts 63 are hingedly connected to the bosses 62 and are placed in clamping relation with slotted keeper members or ears 64 mounted on the ring 36 by means of nuts 65.

The Operation

The flow of oxygen through the lance nozzle and water through the inlet pipe, water chamber of the nozzle and through the outlet pipes is conventional.

The unique features of the present invention reside in the quick disconnect of the main portion or barrel lance from the top support member 11 when the lance is to be serviced and portions have to be replaced. Release of the swinging bolts 63 from the keeper 64 permits the lower portion of the lance and lower pipes to be dropped downwardly whereupon access is easily provided to replace seals, etc., and to conduct other repairs. The sleeve 27 which may be of brass or similar material can easily be replaced by disconnecting the cap screws 35.

The arrangement disclosed provides for effective sealing of all areas where leakage is possible and any leakage from the oxygen pipes through the slip joint connector of the piston member 50, or of water from the inlet pipe 55, or of water or oxygen from the connector assembly, is easily and safely vented into the atmosphere. Thus all important and necessary surfaces are effectively sealed. Water cannot leak into the oxygen pipe nor can oxygen leak into the water pipes.

The circumferential slots are easily and quickly registered upon reassembly of the lance.

What is claimed is:

1. A steel making lance assembly comprising a top support member, said support member including a first central oxygen supply pipe and second and third water inlet and outlet pipe, a first connector plate assembly on said top support member, said first plate assembly having a lower flat surface including a first central opening communicating with said first supply pipe, said lower flat surface including a plurality of first positioned openings communicating with said second and third pipes, a second connector plate assembly, said second connector plate assembly including a sleeve member having a flange and a flat annular upper surface provided with a second central opening communicating with said first central opening, said flat upper surface including a plurality of second openings adapted to register with said first openings, means releasably connecting said flange of said sleeve member to said lower flat surface of said first connector plate assembly with said sleeve projecting downwardly with respect thereto, a connector ring extending around said sleeve member, said connector ring having a plurality of third spaced openings registering with said first and second openings, a fourth oxygen pipe having its upper end projecting into said sleeve in telescoping sliding relation and communicating with said central openings and said first oxygen supply pipe, fifth and sixth water inlet and outlet pipes concentric with said fourth pipes connected to said connector ring and communicating with said first, second and third openings, a nozzle connected to said fourth, fifth and sixth pipes, said nozzle including a discharge orifice connected to said fourth pipe and a water chamber communicating with said fifth and sixth pipes, and means quick releasably connecting said ring to said first and second connector assemblies whereby said ring may be quickly removed with said fourth, fifth and sixth pipes from said sleeve and flange of said second connector plate assembly.

2. The invention in accordance with claim 1, said fourth oxygen pipe having an annular top head including O-ring seals in engagement with the inner wall of said sleeve.

3. The invention in accordance with claim 2, said annular head including upper and lower O-ring seals, and vent passage means communicating through said sleeve with said head between said seals, said vent passage means communicating with the atmosphere.

4. The invention in accordance with claim 3, said annular head between said O-ring seal including a vent chamber communicating with said vent passage means.

5. The invention in accordance with claim 4,
said vent passage means including a bore extending through said ring to the atmosphere.

6. The invention in accordance with claim 1,
said flat annular upper surface of said sleeve having an O-ring seal spaced outwardly from said central openings between said central openings and said first and second openings.

7. The invention in accordance with claim 1,
said connector ring having a flat upper surface within which said third openings are positioned,
said ring flat upper surface supporting a pair of O-rings engaging the lower surface of said sleeve flange in sealing relation relative to said third openings.

8. The invention in accordance with claim 7,
said sleeve having an outer surface engaging an inner surface of said ring, and
an O-ring between said surfaces for sealing the same.

9. The invention in accordance with claim 1,
said openings comprising arcuate slots.

10. The invention in accordance with claim 9,
said arcuate slots being positioned in radially spaced pairs.

11. The invention in accordance with claim 10,
said first connector plate assembly including a peripheral flange projecting downwardly in overlapping relation relative to said first flange.

12. The invention in accordance with claim 11
said third openings in said slots being spaced to provide a plurality of radially extending solid webs in said ring, and
said vent passage means including a plurality of vent passages extending through said webs.

* * * * *